US009686621B2

(12) United States Patent
Akdeniz et al.

(10) Patent No.: US 9,686,621 B2
(45) Date of Patent: Jun. 20, 2017

(54) HEARING AID WITH AN ANTENNA

(71) Applicant: GN Hearing A/S, Ballerup (DK)

(72) Inventors: Birol Akdeniz, Brondby Strand (DK); Jens Henrik Steffens, Bronshoj (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/202,486

(22) Filed: Mar. 10, 2014

(65) Prior Publication Data

US 2015/0131831 A1 May 14, 2015

(30) Foreign Application Priority Data

Nov. 11, 2013 (DK) ..... 2013 70666
Nov. 11, 2013 (EP) ..... 13192322

(51) Int. Cl.
*H04R 25/00* (2006.01)

(52) U.S. Cl.
CPC ..... *H04R 25/554* (2013.01); *H04R 2225/021* (2013.01); *H04R 2225/51* (2013.01)

(58) Field of Classification Search
CPC ..... H04R 25/43; H04R 2460/13; H04R 2225/023
USPC ..... 381/23.1, 312, 315, 388, 324, 328, 330, 381/331
See application file for complete search history.

(56) References Cited

U.S. PATENT DOCUMENTS 2,535,063 A 12/1950 Halstead
3,276,028 A * 9/1966 Mayes et al. ..... 343/792.5
4,334,315 A 6/1982 Ono et al.
4,652,888 A * 3/1987 Deasy ..... H01Q 9/38 343/791
4,741,339 A 5/1988 Harrison et al.
(Continued)

FOREIGN PATENT DOCUMENTS

CN 1684549 A 10/2005
CN 101835082 A 9/2010
(Continued)

OTHER PUBLICATIONS

Final Office Action dated Feb. 27, 2014, for U.S. Appl. No. 13/271,180.
(Continued)

*Primary Examiner* — Md S Elahee
*Assistant Examiner* — Julie X Dang
(74) *Attorney, Agent, or Firm* — Vista IP Law Group, LLP

(57) ABSTRACT

A hearing aid with an assembly, the assembly includes: a first side; a second side; a signal processor; a wireless communications unit, the wireless communications unit being connected to the signal processor; and a monopole antenna for electromagnetic field emission and electromagnetic field reception, the antenna being connected to the wireless communications unit, the antenna having an excitation point; wherein at least a part of a first branch of the antenna extends from the excitation point along the first side of the assembly, the first branch having a first end, the first end being free or being coupled with the excitation point via a third branch; and wherein a second branch of the antenna extends from the excitation point, at least a part of the second branch extending in a space located between the first side of the assembly and the second side of the assembly.

17 Claims, 8 Drawing Sheets

(56) References Cited

U.S. PATENT DOCUMENTS

| | | | | |
|---|---|---|---|---|
| 4,924,237 | A | 5/1990 | Honda et al. | |
| 5,426,719 | A | 6/1995 | Franks | |
| 5,621,422 | A | 4/1997 | Wang | |
| 5,721,783 | A | 2/1998 | Anderson | |
| 5,760,746 | A | 6/1998 | Kawahata | |
| 5,761,319 | A | 6/1998 | Dar et al. | |
| 6,161,036 | A * | 12/2000 | Matsumura | A61B 5/0006 128/903 |
| 6,456,720 | B1 | 9/2002 | Brimhall | |
| 6,515,629 | B1 | 2/2003 | Kuo | |
| 6,748,094 | B1 | 6/2004 | Tziviskos et al. | |
| 6,766,201 | B2 | 7/2004 | Von Arx et al. | |
| 6,911,944 | B2 | 6/2005 | Sekine | |
| 6,924,773 | B1 | 8/2005 | Paratte | |
| 7,002,521 | B2 | 2/2006 | Egawa et al. | |
| 7,020,298 | B1 | 3/2006 | Tziviskos et al. | |
| 7,154,442 | B2 | 12/2006 | Van Wonterghem et al. | |
| 7,256,747 | B2 | 8/2007 | Victorian et al. | |
| 7,446,708 | B1 * | 11/2008 | Nguyen | H01Q 1/362 343/700 MS |
| 7,570,777 | B1 | 8/2009 | Taenzer et al. | |
| 7,593,538 | B2 | 9/2009 | Polinske | |
| 7,630,772 | B1 | 12/2009 | Walsh | |
| 7,652,628 | B2 | 1/2010 | Zweers | |
| 7,791,551 | B2 | 9/2010 | Platz | |
| 7,978,141 | B2 | 7/2011 | Chi et al. | |
| 8,494,197 | B2 | 7/2013 | Polinske et al. | |
| 8,934,984 | B2 | 1/2015 | Meskens et al. | |
| 2003/0098812 | A1 | 5/2003 | Ying | |
| 2004/0073275 | A1 | 4/2004 | Maltan et al. | |
| 2004/0080457 | A1 | 4/2004 | Guo | |
| 2004/0138723 | A1 | 7/2004 | Malick et al. | |
| 2004/0246179 | A1 | 12/2004 | Chen | |
| 2005/0068234 | A1 | 3/2005 | Hung et al. | |
| 2005/0094840 | A1 | 5/2005 | Harano | |
| 2005/0099341 | A1 | 5/2005 | Zhang et al. | |
| 2005/0244024 | A1 | 11/2005 | Fischer et al. | |
| 2005/0248717 | A1 | 11/2005 | Howell et al. | |
| 2005/0251225 | A1 | 11/2005 | Faltys et al. | |
| 2006/0012524 | A1 | 1/2006 | Mierke et al. | |
| 2006/0018496 | A1 | 1/2006 | Niederdrank et al. | |
| 2006/0052144 | A1 | 3/2006 | Seil et al. | |
| 2006/0061512 | A1 | 3/2006 | Asano et al. | |
| 2006/0064037 | A1 | 3/2006 | Shalon | |
| 2006/0071869 | A1 | 4/2006 | Yoshino et al. | |
| 2006/0115103 | A1 | 6/2006 | Feng et al. | |
| 2006/0181466 | A1 | 8/2006 | Krupa | |
| 2007/0080889 | A1 | 4/2007 | Zhang | |
| 2007/0171134 | A1 | 7/2007 | Yoshino et al. | |
| 2007/0229369 | A1 | 10/2007 | Platz | |
| 2007/0229376 | A1 | 10/2007 | Desclos et al. | |
| 2007/0230714 | A1 | 10/2007 | Armstrong | |
| 2007/0285321 | A1 | 12/2007 | Chung | |
| 2008/0056520 | A1 | 3/2008 | Christensen et al. | |
| 2008/0079645 | A1 | 4/2008 | Higasa et al. | |
| 2008/0231524 | A1 | 9/2008 | Zeiger et al. | |
| 2008/0304686 | A1 | 12/2008 | Meskens et al. | |
| 2009/0074221 | A1 | 3/2009 | Westermann | |
| 2009/0124201 | A1 | 5/2009 | Meskens | |
| 2009/0169038 | A1 | 7/2009 | Knudsen et al. | |
| 2009/0196444 | A1 | 8/2009 | Solum | |
| 2009/0231204 | A1 | 9/2009 | Shaker et al. | |
| 2009/0231211 | A1 | 9/2009 | Zweers | |
| 2009/0243944 | A1 | 10/2009 | Jung et al. | |
| 2009/0273530 | A1 | 11/2009 | Chi et al. | |
| 2009/0315787 | A1 | 12/2009 | Schatzle | |
| 2010/0020994 | A1 | 1/2010 | Christensen et al. | |
| 2010/0109953 | A1 * | 5/2010 | Tang | H01Q 1/243 343/700 MS |
| 2010/0158291 | A1 | 6/2010 | Polinske et al. | |
| 2010/0158293 | A1 * | 6/2010 | Polinske | H01Q 1/243 381/315 |
| 2010/0158295 | A1 | 6/2010 | Polinske et al. | |
| 2010/0172525 | A1 | 7/2010 | Angst et al. | |
| 2010/0321269 | A1 | 12/2010 | Ishibana et al. | |
| 2011/0022121 | A1 | 1/2011 | Meskins | |
| 2011/0129094 | A1 | 6/2011 | Petersen | |
| 2011/0249836 | A1 | 10/2011 | Solum | |
| 2011/0285599 | A1 | 11/2011 | Smith | |
| 2011/0294537 | A1 * | 12/2011 | Vance | 455/550.1 |
| 2012/0087506 | A1 | 4/2012 | Ozden | |
| 2012/0093324 | A1 * | 4/2012 | Sinasi | 381/23.1 |
| 2012/0154222 | A1 | 6/2012 | Oh et al. | |
| 2012/0326938 | A1 | 12/2012 | Grossman | |
| 2013/0308805 | A1 | 11/2013 | Ozden Sinasi | |
| 2013/0342407 | A1 | 12/2013 | Kvist | |
| 2014/0010392 | A1 | 1/2014 | Kvist | |
| 2014/0097993 | A1 | 4/2014 | Hotta | |
| 2014/0185848 | A1 * | 7/2014 | Ozden et al. | 381/315 |
| 2014/0321685 | A1 | 10/2014 | Rabel | |
| 2014/0378958 | A1 | 12/2014 | Leussler | |

FOREIGN PATENT DOCUMENTS

| | | | | |
|---|---|---|---|---|
| CN | 102318138 | A | 1/2012 | |
| DE | 3625891 | A1 | 2/1988 | |
| DE | 10 2004 01783 | | 10/2005 | |
| DE | 10 2004 017832 | | 10/2005 | |
| DE | 10 2008 022 127 | A1 | 11/2009 | |
| EP | 1 231 819 | A2 | 8/2002 | |
| EP | 1294049 | A1 | 3/2003 | |
| EP | 1 465 457 | A2 | 10/2004 | |
| EP | 1 465 457 | A3 | 10/2004 | |
| EP | 1 589 609 | A2 | 10/2005 | |
| EP | 1 594 188 | A1 | 11/2005 | |
| EP | 1 681 903 | A2 | 7/2006 | |
| EP | 1 763 145 | A1 | 3/2007 | |
| EP | 1939984 | A1 | 2/2008 | |
| EP | 1 953 934 | A1 | 8/2008 | |
| EP | 2 200 120 | A2 | 6/2010 | |
| EP | 2 200 120 | A3 | 6/2010 | |
| EP | 2 207 238 | A1 | 7/2010 | |
| EP | 2 229 009 | A1 | 9/2010 | |
| EP | 2 302 737 | | 3/2011 | |
| EP | 2 458 674 | A2 | 5/2012 | |
| EP | 2637251 | A1 | 11/2013 | |
| EP | 2 680 366 | | 1/2014 | |
| EP | 2 723 101 | A2 | 4/2014 | |
| EP | 2 723 101 | A3 | 4/2014 | |
| EP | 2 765 650 | | 8/2014 | |
| JP | S59-97204 | | 6/1984 | |
| JP | H10-209739 | | 8/1998 | |
| JP | 2005-304038 | A | 10/2005 | |
| JP | 2006025392 | | 1/2006 | |
| JP | 2006-033853 | A | 2/2006 | |
| JP | WO2011099226 | A1 * | 12/2011 | H01Q 1/24 |
| JP | 2012-090266 | | 5/2012 | |
| JP | WO2012059302 | A2 * | 5/2012 | H01Q 1/52 |
| WO | WO 98/44762 | | 10/1998 | |
| WO | WO 03/026342 | | 3/2003 | |
| WO | WO 2004/110099 | A2 | 12/2004 | |
| WO | WO 2005/076407 | A2 | 8/2005 | |
| WO | WO 2005/081583 | A1 | 9/2005 | |
| WO | WO 2006/055884 | A2 | 5/2006 | |
| WO | WO 2006122836 | A2 | 11/2006 | |
| WO | WO 2007/045254 | A1 | 4/2007 | |
| WO | WO 2007/140403 | A2 | 6/2007 | |
| WO | 2008012355 | A1 | 1/2008 | |
| WO | WO 2009/010724 | A1 | 1/2009 | |
| WO | WO 2009/098858 | A1 | 8/2009 | |
| WO | WO 2009/117778 | A1 | 10/2009 | |
| WO | WO 2010/065356 | A1 | 6/2010 | |
| WO | WO 2014/090420 | A1 | 6/2014 | |

OTHER PUBLICATIONS

Extended European Search Report dated Mar. 7, 2014 for EP Patent Application No. 11184507.9. (P81101358EP00)

Second Danish Office Action dated Apr. 24, 2012 for Danish Patent Application No. PA 2010 00931.

First Danish Office Action dated Apr. 26, 2011 for Danish Patent Application No. PA 2010 00931.

(56) References Cited

OTHER PUBLICATIONS

Danish Office Action dated Apr. 30, 2012 for Danish Patent Application No. PA 2011 70566.
Danish Office Action dated May 1, 2012 for Danish Patent Application No. PA 2011 70567.
English Abstract of Foreign Reference DE 10 2008 022 127 A1 (included in 1st pages of Foreign Ref.
Third Danish Office Action dated Oct. 17, 2012 for Danish Patent Application No. PA 2010 00931.
First Office Action dated Feb. 12, 2013 for Japanese Patent Application No. 2011-224711.
Fourth Danish Office Action , Intention to Grant dated Feb. 13, 2013 for Danish Patent Application No. PA 2010 00931.
Notice of Reasons for Rejection dated May 21, 2013 for Japanese Patent Application No. 2011-224705.
Non-final Office Action dated Oct. 8, 2013 for U.S. Appl. No. 13/271,180.
Chinese Office Action and Search Report dated Nov. 12, 2013 for related CN Patent Application No. 201110317264.6.
Chinese Office Action and Search Report dated Dec. 4, 2013 for related CN Patent Application No. 201110317229.4.
1st Technical Examination and Search Report dated Jan. 25, 2013 for DK Patent Application No. PA 2012 70412, 4 pages.
1st Technical Examination and Search Report dated Jan. 24, 2013 for DK Patent Application No. PA 2012 70411, 5 pages.
Second Technical Examination dated Aug. 6, 2013 for DK Patent Application No. PA 2012 70411, 2 pages.
Second Technical Examination—Intention to Grant dated Jul. 8, 2013 for DK Patent Application No. PA 2012 70412, 2 pages.
Non-final Office Action dated Jan. 2, 2014 for U.S. Appl. No. 13/740,471.
First Technical Examination and Search Report Dated Jan. 18, 2013 for DK Patent Application No. PA 2012 70410, 4 pages.
Second Technical Examination dated Jul. 12, 2013, for DK Patent Application No. PA 2012 70410, 2 pages.
Third Technical Examination dated Jan. 31, 2014, for DK Patent Application No. PA 2012 70410, 2 pages.
Office Action dated Jun. 17, 2014 in Japanese Patent Application No. 2013-258396, 3 pages.
First Technical Examination dated Jun. 25, 2014 for DK Patent Application No. PA 2013 70665, 5 pages.
First Technical Examination dated Jun. 26, 2014 for DK Patent Application No. PA 2013 70664, 5 pages.
Extended European Search Report dated May 14, 2014 for EP Patent Application No. 13192322.9.
First Technical Examination and Search Report dated Jun. 26, 2014 for DK Patent Application No. PA 2013 70667, 5 pages.
First Technical Examination and Search Report dated Jun. 27, 2014 for DK Patent Application No. PA 2013 70666.
Notice of Allowance and Fee(s) Due dated Jun. 18, 2015, for U.S. Appl. No. 13/917,448.
Notice of Allowance dated Mar. 5, 2015 for U.S. Appl. No. 13/917,448.
Non-final Office Action dated Feb. 5, 2015 for U.S. Appl. No. 14/198,396.
Non-final Office Action dated Nov. 18, 2014 for U.S. Appl. No. 13/271,180.
Conway et al., Antennas for Over-Body-Surface Communication at 2.45 GHz, Apr. 2009, IEEE Transactions on Antennas and Propagation, vol. 57, No. 4, pp. 844-855.
Non-final Office Action dated Nov. 19, 2014 for U.S. Appl. No. 13/931,556.
Non-final Office Action dated Dec. 18, 2014 for U.S. Appl. No. 13/740,471.
Final Office Action dated Dec. 31, 2014 for U.S. Appl. No. 13/271,170.
Non-final Office Action dated Jan. 5, 2015 for U.S. Appl. No. 13/848,605.
Extended European Search Report dated Oct. 9, 2014 for EP Patent Application No. 14181165.3.
Examiner Bengtsson, Rune, "Novelty Search including a Preliminary Patentability Opinion Report", in reference to P81007295DK02, dated Jul. 28, 2011 (8 pages).
"Novelty Search including a Preliminary Patentability Opinion Report", in reference to P81101358DK01, dated Jul. 28, 2011 (8 pages).
Non-final Office Action dated Jan. 15, 2015 for U.S. Appl. No. 14/199,511.
Notice of Allowance and Fee(s) Due dated Nov. 18, 2015 for related U.S. Appl. No. 13/931,556.
Final Office Action dated Nov. 18, 2015 for related U.S. Appl. No. 14/199,263.
Non-final Office Action dated Dec. 2, 2015 for related U.S. Appl. No. 13/271,180.
Notice of Allowance and Fee(s) Due dated Dec. 18, 2015 for related U.S. Appl. No. 13/917,448.
Notification of Reasons for Rejection dated Nov. 24, 2015 for related Japanese Patent Application No. 2014-228343, 8 pages.
Notice of Allowance and Fee(s) Due dated Feb. 16, 2016 for related U.S. Appl. No. 13/740,471.
Advisory Action dated Feb. 1, 2016 for related U.S. Appl. No. 14/199,263.
Notice of Allowance and Fees Due dated Mar. 3, 2016 for related U.S. Appl. No. 13/931,556.
Notice of Allowance and Fee(s) due dated Mar. 23, 2016 for related U.S. Appl. No. 14/198,396.
Final Office Action dated Apr. 4, 2016 for related U.S. Appl. No. 13/271,180.
Final Office Action dated Apr. 15, 2016 for related U.S. Appl. No. 14/199,070.
Notice of Allowance and Fee(s) dated May 25, 2016 for related U.S. Appl. No. 14/199,263.
Notice of Allowance and Fee(s) dated Jun. 17, 2016 for related U.S. Appl. No. 13/917,448.
Advisory Action dated Jul. 26, 2016 for related U.S. Appl. No. 13/271,180.
Non-final Office Action dated Sep. 15, 2011 for related U.S. Appl. No. 12/131,867.
Non-final Office Action dated Feb. 10, 2012 for related U.S. Appl. No. 12/131,867.
Final Office Action dated Aug. 23, 2012 for related U.S. Appl. No. 12/131,867.
Non-Final Office Action dated Mar. 7, 2014 for related U.S. Appl. No. 12/131,867.
Notice of Allowance and Fee(s) due dated Sep. 12, 2014 for related U.S. Appl. No. 12/131,867.
Non-final Office Action dated Sep. 29, 2016 for related U.S. Appl. No. 14/461,983.
Notice of Allowance and Fee(s) due dated Oct. 5, 2016 for related U.S. Appl. No. 13/271,180.
Non-final Office Action dated Oct. 24, 2016 for related U.S. Appl. No. 14/199,070.
Final Office Action dated Jul. 15, 2015 for related U.S. Appl. No. 13/740,471.
Notice of Allowance and Fees Due dated Aug. 3, 2015 for related U.S. Appl. No. 13/931,556.
Non-final Office Action dated Aug. 17, 2015 for related U.S. Appl. No. 14/198,396.
Notice of Allowance and Fee(s) Due dated Sep. 2, 2015 for related U.S. Appl. No. 14/199,511.
Notice of Allowance and Fee(s) Due dated Sep. 3, 2015 for related U.S. Appl. No. 13/848,605.
Notice of Allowance and Fee(s) Due dated Sep. 25, 2015 for related U.S. Appl. No. 13/271,170.
Notice of Allowance dated Apr. 24, 2015 for U.S. Appl. No. 13/931,556.
First Technical Examination and Search Report dated Mar. 9, 2015, for related Danish Patent Application No. PA 2014 70489.
Non-final Office Action dated May 7, 2015 for U.S. Appl. No. 13/271,180.
Advisory Action dated May 14, 2015 for U.S. Appl. No. 13/271,170.

(56) References Cited

OTHER PUBLICATIONS

Notice of Allowance and Fee(s) Due dated May 22, 2015 for U.S. Appl. No. 13/848,605.
Non-final Office Action dated Jun. 10, 2015 for U.S. Appl. No. 14/199,263.
Notice of Allowance and Fec(s) Due dated Jun. 18, 2015, for U.S. Appl. No. 13/917,448.
Communication pursuant to Article 94(3) EPC dated Mar. 16, 2015, for related European Patent Application No. 11 184 503.8, 12 pages.
Communication pursuant to Article 94(3) EPC dated Mar. 19, 2015, for related European Patent Application No. 11 184 507.9, 12 pages.
Non-final Office Action dated Jul. 1, 2015 for U.S. Appl. No. 14/199,070.
Final Office Action dated May 19, 2014 for U.S. Appl. No. 13/740,471.
Non-Final Office Action dated Mar. 27, 2014 for U.S. Appl. No. 13/848,605.
Extended European Search Report dated Mar. 7, 2014 for EP Patent Application No. 11184503.8.
Extended European Search Report dated May 6, 2014 for EP Patent Application No. 13175258.6.
Extended European Search Report dated Apr. 17, 2014 for EP Patent Application No. 13192316.1.
Extended European Search Report dated Apr. 22, 2014 for EP Patent Application No. 13192323.7.
Non-Final Office Action dated May 22, 2014 for U.S. Appl. No. 13/271,170.
European Communication pursuant to Article 94(3) EPC dated Dec. 20, 2016 for related EP Patent Application No. 13192323.7, 4 pages.
Notification of First Office Action dated Jan. 26, 2017 for related Chinese Patent Application No. 201310713296.7, 21 pages.
Notice of Allowance and Fee(s) due dated Apr. 11, 2017 for related U.S. Appl. No. 13/271,180.
Notification of First Office Action dated Feb. 21, 2017 for corresponding Chinese Patent Application No. 201410641926.9, 16 pages.
Non-final Office Action dated May 12, 2017 for related U.S. Appl. No. 15/455,081.

* cited by examiner

HEARING AID WITH AN ANTENNA

RELATED APPLICATION DATA

This application claims priority to and the benefit of Danish Patent Application No. PA 2013 70666 filed on Nov. 11, 2013, pending, and European Patent Application No. 13192322.9 filed on Nov. 11, 2013, pending. The entire disclosures of both of the above applications are expressly incorporated by reference herein.

TECHNICAL FIELD

The present disclosure relates to the field of hearing aids having antennas, especially adapted for wireless communication, such as for wireless communication with accessory and/or other hearing aids.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Moreover, the antenna in the hearing aid has to be designed to achieve a satisfactory ear-to-ear performance despite the limitation and other high design constraints imposed by the size of the hearing aid.

SUMMARY

It is an object to overcome at least some of the disadvantages as mentioned above, and it is a further object to provide a hearing aid. The hearing aid comprises a hearing aid assembly having a first side and a second side, a signal processor, and a wireless communications unit. The wireless communications unit is connected to the signal processor. The hearing aid comprises a monopole antenna for emission and reception of an electromagnetic field. The antenna is connected to the wireless communications unit. The antenna has an excitation point and a first branch of the antenna extends from the excitation point along the first side of the hearing aid assembly. The first branch has a first end, the first end being free or being interconnected with the excitation point via a third branch. The antenna further has a second branch of the antenna which extends from the excitation point. At least a part of the second branch extends from the first side to the second side.

Typically, the antenna is configured so that current flowing in the antenna forms standing waves along the length of the antenna. The length of an antenna may for example be tailored so that the length of the antenna equals a quarter wavelength of the desired electromagnetic field, or any multiple, or any odd multiple, thereof. In one or more embodiments, an absolute relative difference between the total length of the antenna and the wavelength may be less than a threshold, such as less than 10%, 25%, etc. In some embodiments a total length of the antenna is between three quarters of a wavelength and five quarters of a wavelength.

In some embodiments, a current in the antenna may have a maximum in the second branch, such as for example in the part of the second branch which extends from the first side to the second side.

The first end may be free, so that the first end may be a free end or an open end. If the first end is free, the current at the end of the first branch may be near zero. Alternatively, the first end may be interconnected with the excitation point via a third branch. The third branch may be different from the first branch. The current in the third branch may have a local maximum near the excitation point, such as a further local maximum. The third branch may extend primarily along a first side of the hearing aid assembly.

Likewise, the second end may be free, so that the second end may be a free end or an open end. If the second end is free, the current at the end of the second branch may be near zero. Alternatively, the second end may be interconnected with the excitation point via at least a fourth branch. The fourth branch may be different from the second branch. In some embodiments, the fourth branch extends primarily along the second side of the hearing aid assembly.

In one or more embodiments, the first and/or second branch may form a loop. The loop formed by the first and/or the second branch may return to the excitation point. An advantage of a loop formed by the first and/or the second branch is that it may provide a relatively long total length of the antenna and therefore may improve the ear-to-ear performance of the hearing aid. In some embodiments, the first and/or second branch may be a plate or a dish of conductive material.

In some embodiments, the first antenna branch may form a loop along the first side and/or the second antenna branch may form a loop along the second side.

At least a part of the second branch extends from the first side to the second side. The part of the second antenna branch may thus extend from proximate the first side of the hearing aid assembly to proximate the second side of the hearing aid assembly, such as from adjacent the first side to adjacent the second side, or the at least part of the second branch may extend from a point or position at or along the first side to a point or position at or along the second side.

In some embodiments at least another part of the second branch extends on the second side.

At least a part of the first branch may extend along the first side, and/or at least a part of the second branch may extend along the second side. The first side may be a longitudinal side of the hearing aid assembly and the second side may be another longitudinal side of the hearing aid assembly. The first side may be opposite the second side. The second branch may be partly parallel to the first branch. In some embodiments, the part of the first branch extending along the first side of the hearing aid, and the part, i.e. the other part, of the second branch extending along the second side of the hearing aid may be symmetric parts, i.e. so that the said parts form symmetric antenna structures about a plane through the antenna, and/or so that the said parts may have an, at least substantially, same shape.

In general, various sections of the antenna may be formed having different geometries, the sections may be wires or patches, bend or straight, long or short as long as they obey the above relative configuration with respect to each other as disclosed herein.

The hearing aid may be a behind-the-ear hearing aid configured to be positioned behind the ear of the user during use, and the first side may be a first longitudinal side of the hearing aid and the second side may be a second longitudinal side of the hearing aid. The antenna may be accommodated in the housing with its longitudinal direction along the length of the housing. Preferably, the antenna is accommodated within the hearing aid housing, preferably so that the antenna is positioned inside the hearing aid housing without protruding out of the housing.

Typically, an excitation point is electrically connected to a source, such as the wireless communication unit, such as a radio chip, such as a transceiver, a receiver, a transmitter, etc. The antenna may be excited using any conventional means, using a direct or an indirect or coupled feed, and for example be fed using a feed line, such as a transmission line. The current induced in the antenna may have a first local maximum at a proximate excitation point of the antenna.

The first branch of the antenna may extend from the excitation point to a first end of the antenna, and the second branch of the antenna may extend from the excitation point to a second end of the antenna. The antenna may be structured with two branches extending from the same excitation point.

A first distance from the excitation point to the first end may be smaller than a second distance from the excitation point to the second end. In some embodiments, the relative difference between the first distance and the second distance may be less than 25%, such as less than 10%. The distance may be measured along the first branch and along the second branch, respectively.

In some embodiments, the excitation point may be provided at an edge part of the hearing aid assembly. The excitation point may be interconnected with the wireless communications unit for example via transmission lines.

The antenna may be configured with a length and a structure so that a current in the antenna may have a magnitude of zero at a point on the first branch and/or at a point on the second branch.

In some embodiments, the first antenna branch has a first length and the second antenna branch has a second length, and wherein the sum of the first length and the second length may correspond to at least 90% of a total length of the antenna.

The length of the first branch and/or the length of the second branch may be at least $\lambda/4$, such as substantially $\lambda/4$, such as at least $\lambda/4+/-10\%$.

The first length may correspond to the second length, so that the first and second branches have a same length, or the first length of the first branch may be different from the length of the second branch.

The first branch may have a first length and the second branch may have a second length. The first length may be different from the second length, and in one or more embodiments, the second length may be longer than the first length. The length of the first or the second branch may be equal to, such as substantially equal to $\lambda/4$, where $\lambda$ corresponds to the frequency of the wireless communications unit. The first length and/or the second length may be at least $\lambda/4$.

The hearing aid disclosed herein may be configured for operation in ISM frequency band. Preferably, the antennas are configured for operation at a frequency of at least 1 GHz, such as at a frequency between 1.5 GHz and 3 GHz such as at a frequency of 2.4 GHz.

A hearing aid with an assembly, the assembly includes: a first side; a second side; a signal processor; a wireless communications unit, the wireless communications unit being connected to the signal processor; and a monopole antenna for electromagnetic field emission and electromagnetic field reception, the antenna being connected to the wireless communications unit, the antenna having an excitation point; wherein at least a part of a first branch of the antenna extends from the excitation point along the first side of the assembly, the first branch having a first end, the first end being free or being coupled with the excitation point via a third branch; and wherein a second branch of the antenna extends from the excitation point, at least a part of the second branch extending in a space located between the first side of the assembly and the second side of the assembly.

Optionally, a current in the antenna has a maximum in the second branch.

Optionally, the excitation point is at an edge part of the assembly.

Optionally, the first branch has a first length and the second branch has a second length, and wherein a sum of the first length and the second length is at least 90% of a total length of the antenna.

Optionally, the length of the first branch corresponds to the length of the second branch.

Optionally, the first branch forms a loop along the first side of the assembly.

Optionally, the at least a part of the second branch extends from proximate the first side of the assembly to proximate the second side of the assembly, or from the first side of the assembly to the second side of the assembly.

Optionally, a length of the first branch is at least $\lambda/4$, and/or a length of the second branch is at least $\lambda/4$.

Optionally, a current in the antenna has a magnitude of zero at a point on the first branch and/or at a point on the second branch.

Optionally, the second branch has a second end, and wherein the second end is free.

Optionally, the second branch has a second end, and wherein the second end is coupled with the excitation point via a forth branch, the forth branch being different from the second branch.

Optionally, the second branch forms a loop along the second side.

Optionally, a part of the second branch extends on the second side.

Optionally, the first side is opposite the second side, and wherein the first side of the assembly corresponds with a first longitudinal side of the hearing aid, and the second side of the assembly corresponds with a second longitudinal side of the hearing aid.

Optionally, a part of the second branch extends along the second side, and wherein the at least a part of the first branch extending along the first side and the part of the second branch extending along the second side are symmetric.

Other aspects and features will be evident from reading the following detailed description.

DETAILED DESCRIPTION

Figure 1:
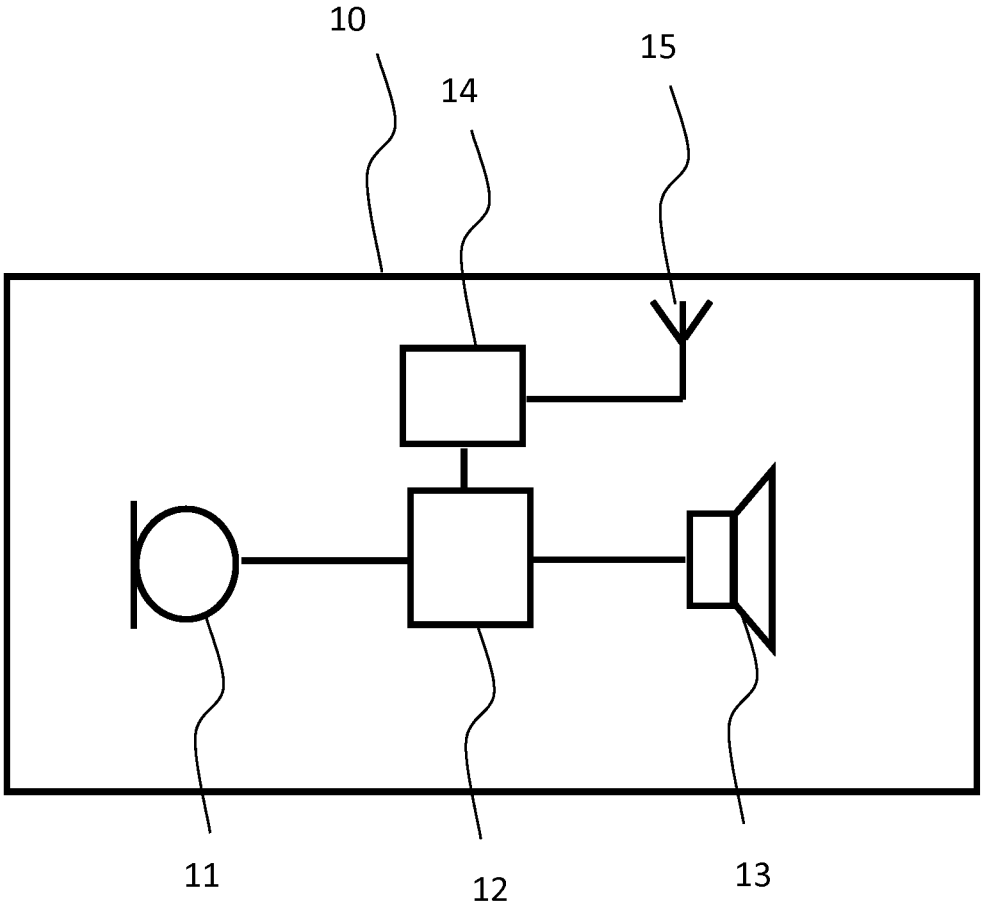
FIG. 1 shows a block-diagram of a hearing aid.

Various embodiments are described hereinafter with reference to the figures, in which exemplary embodiments are shown. The claimed invention may, however, be embodied in different forms and should not be construed as being limited to the embodiments set forth herein. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following, the embodiments are described primarily with reference to a hearing aid, such as a binaural hearing aid. It is however envisaged that the disclosed features and embodiments may be used in combination with any aspect described herein.

As used herein, the term "antenna" refers to an electrical device which converts electric power into radio waves. An antenna, such as an electric antenna, may comprise an electrically conductive material connected to e.g. a wireless communications unit, such as a radio chip, a receiver or a transmitter.

FIG. 1 shows a block-diagram of a hearing aid. In FIG. 1, the hearing aid 10 comprises a microphone 11 for receiving incoming sound and converting it into an audio signal, i.e. a first audio signal. The first audio signal is provided to a signal processor 12 for processing the first audio signal into a second audio signal compensating a hearing loss of a user of the hearing aid. A receiver is connected to an output of the signal processor 12 for converting the second audio signal into an output sound signal, e.g. a signal modified to compensate for a users hearing impairment, and provides the output sound to a speaker 13. Thus, the hearing instrument signal processor 12 may comprise elements such as amplifiers, compressors and noise reduction systems etc. The hearing aid may further have a feedback loop for optimizing the output signal. The hearing aid has a wireless communication unit 14 (e.g. a transceiver) for wireless communication interconnected with an antenna 15 for emission and reception of an electromagnetic field. The wireless communication unit 14 may connect to the hearing aid signal processor 12 and an antenna 15, for communicating with external devices, or with another hearing aid, located at another ear, in a binaural hearing aid system.

The specific wavelength, and thus the frequency of the emitted electromagnetic field, is of importance when considering communication involving an obstacle. In one or more embodiments, the obstacle is a head and the hearing aid comprising an antenna is located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the other hand the wavelength is too short, the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

Figure 2:
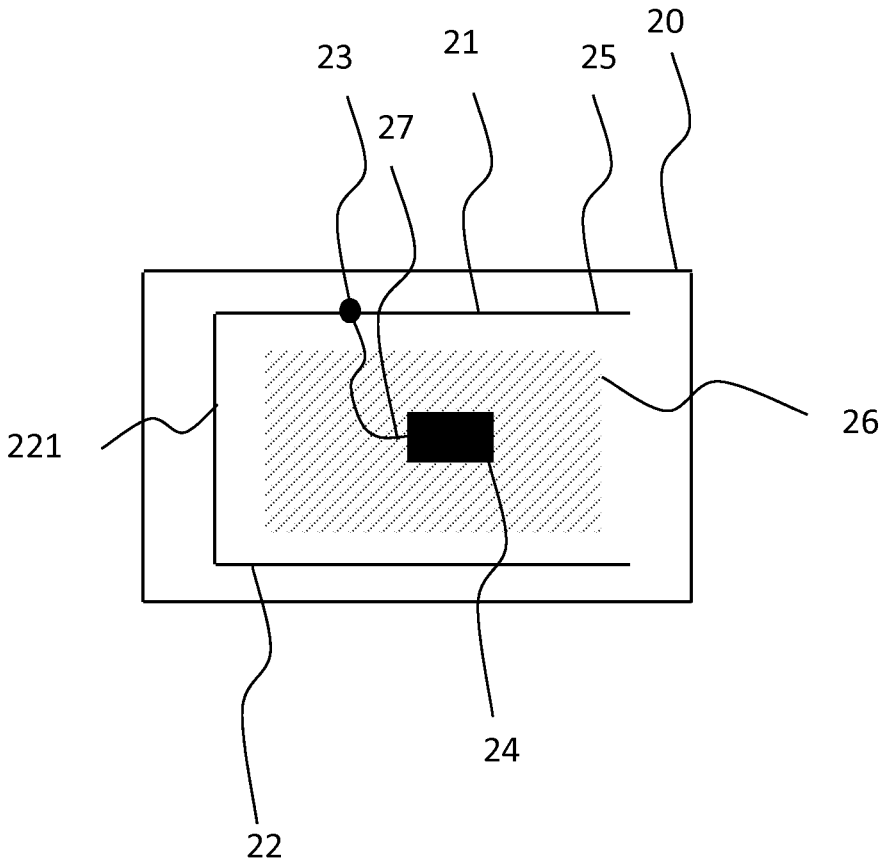
FIG. 2 shows schematically an exemplary implementation of a hearing aid comprising an antenna according to an embodiment of the present disclosure.

FIG. 2 shows schematically an embodiment of a hearing aid 20 comprising an antenna 25, a wireless communications unit 24 and a ground plane 26. Antenna 25 comprises an excitation point 23, a first branch 21, and a second branch 22. The first branch 21 extends from the excitation point 23. The second branch 22 extends from the excitation point 23. The first branch 21 and the second branch 22 may extend from the excitation point 23 in different directions. The excitation point 23 is connected to the wireless communications unit 24 via a transmission line 27. A part 221 of the second branch 22 extends from a first side of the hearing aid 20 to a second side of the hearing aid 20.

In general, various branches of the antenna may be formed with different geometries, they may be wires or patches, bend or straight, long or short as long as they obey the above relative configuration with respect to each other such that the antenna comprises an excitation point, a first branch of the antenna extending from the excitation point and a second branch of the antenna extending from the excitation point and such that the first branch has a first end, the first end being free or being interconnected with the excitation point via a third branch and such that at least a part of the second branch extends from the first side to the second side.

Figure 3:
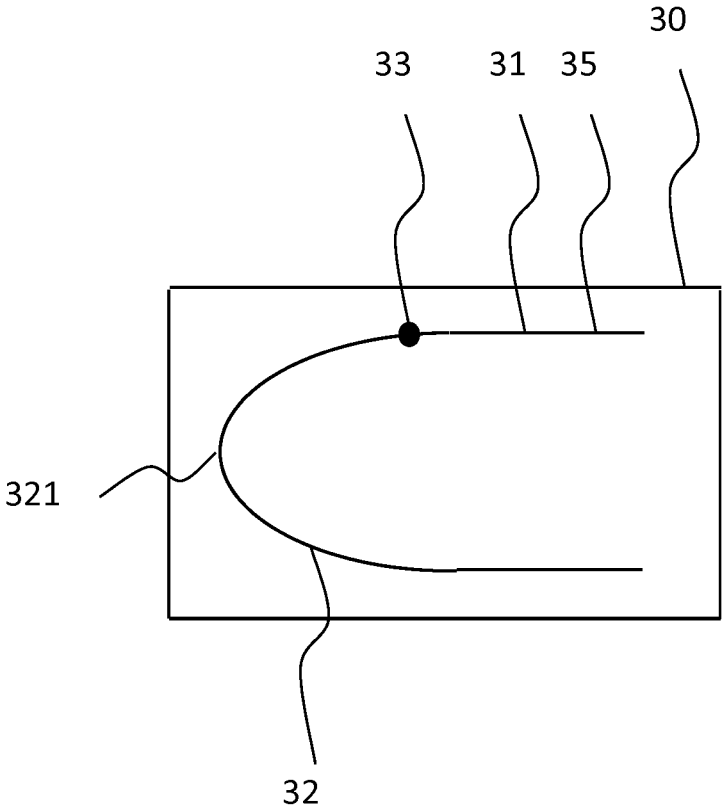
FIG. 3 shows schematically an exemplary implementation of a hearing aid comprising an antenna according to an embodiment of the present disclosure.

FIG. 3 shows schematically an embodiment of a hearing aid 30 according to the present disclosure. The hearing aid 30 comprises an antenna 35. The antenna 35 comprises an excitation point 33, a first branch 31, and a second branch 32. The first branch 31 extends from the excitation point 33. The second branch 32 extends from the excitation point 33. The second branch 32 comprises a part 321 that extends from the first side to the second side, wherein the part 321 extends from the excitation point 33 to the second side in a curve. The first branch 31 and/or the second branch 32 may have any width and/or any shape configured according to hearing aid restrictions and/or antenna optimization. The part 321 may be defined as the part of the antenna which does not extend parallel to the first side and/or the second side but extends from a first side to a second side of the hearing aid assembly.

Figure 4:
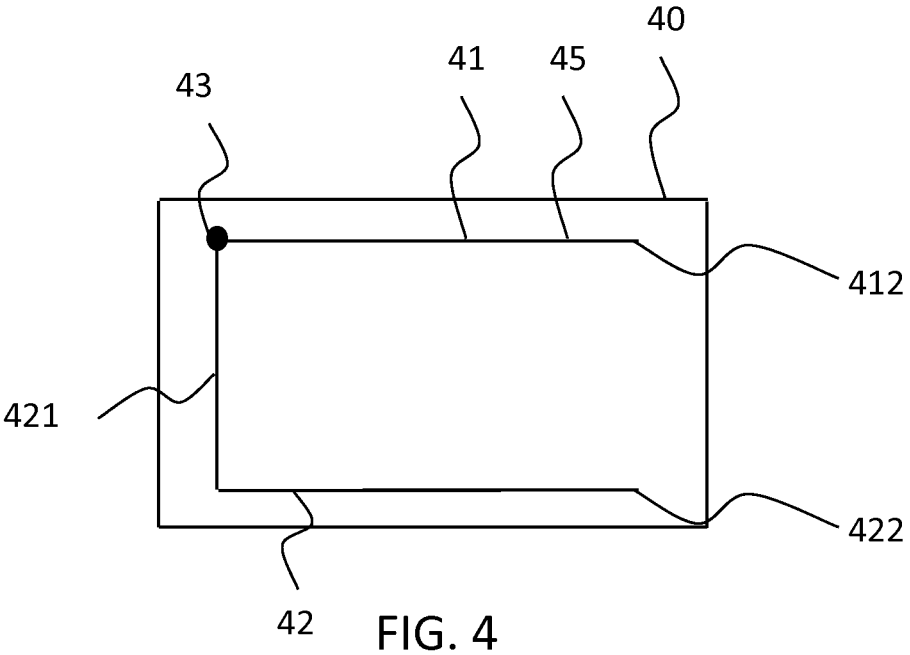
FIG. 4 shows schematically an exemplary implementation of a hearing aid comprising an antenna according to an embodiment of the present disclosure.

FIG. 4 shows schematically an embodiment of a hearing aid 40 according to the present disclosure. The hearing aid 40 comprises an antenna 45. The antenna 45 comprises an excitation point 43, a first branch 41, and a second branch 42. The first branch 41 extends from the excitation point 43 to a first end 412. The second branch 42 extends from the excitation point 43 to a second end 422. In FIG. 4, the second branch 42 comprises a part 421 that extends from a first side of the hearing aid 40 to a second of the hearing aid 40. The part 421 extends from the excitation point 43 positioned at an intersection of the first branch 41 with the second branch 42, wherein the part 421 extends from a first side to a second side directly from the excitation point to thereby obtain a high current at the bridge. The first end 412 and/or the second end 422 may be a free end. The current is seen to be zero at the free ends 412, 422 of the antenna 45. The ends 412, 422 may also be open or have an infinite impedance. Alternatively, the first end 412 and/or the second end 422 may be interconnected with the excitation point 43 via at least a third and/or forth branch. The third branch may be different from the first branch, and/or the forth branch may be different from the second branch.

Figure 5A:
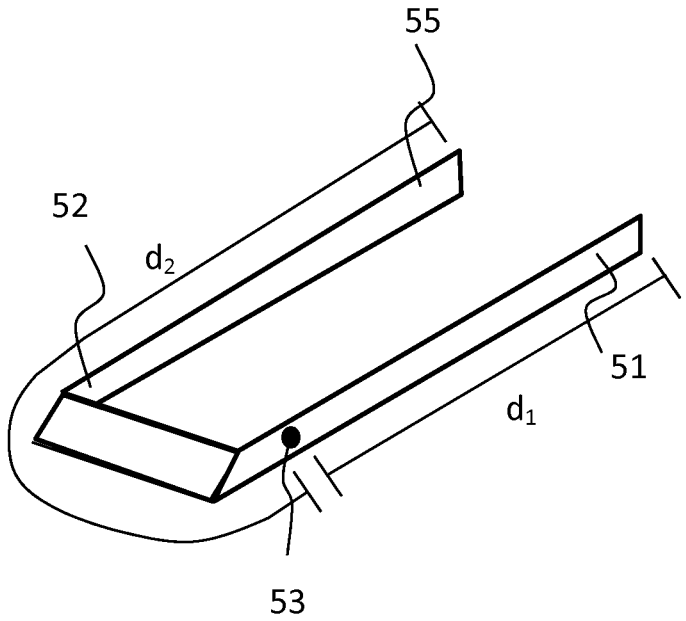
FIGS. 5*a* and 5*b* show schematically an exemplary implementation of a hearing aid comprising an antenna according to an embodiment of the present disclosure.

FIG. 5*a* shows schematically an embodiment of a hearing aid having an antenna according to the present disclosure. The antenna 55 comprises an excitation point 53, a first branch 51, and a second branch 52. The first branch 51 has a first length and the second branch 52 has a second length. The first length and the second length are seen to be different. The second length is longer than the first length. In FIG. 5*a*, a first distance d1 from the excitation point to the first end is smaller than a second distance d2 from the excitation point to the second end. The first or second length may be equal to the first distance d1 or the second distance d2, respectively. The distance is typically measured along the first branch 51 and the second branch 52, respectively.

The relative difference between the first distance d1 and the second distance d2 may be less than a threshold T1. The threshold T1 may be e.g. 25%, or 10%. The antenna 55 may be formed so that the distances d1 and d2 fulfil the following:

$$d_2 > d_1,\ d_1 \approx \frac{1}{4}\lambda \tag{1}$$

$$0 < \left|\frac{d_1 - d_2}{d_2}\right| < T_1,\ T_1 = 25\%,\ 10\%$$

wherein λ is the wavelength. In one or more embodiments, the first length and/or the second length is at least λ/4.

Figure 5B:
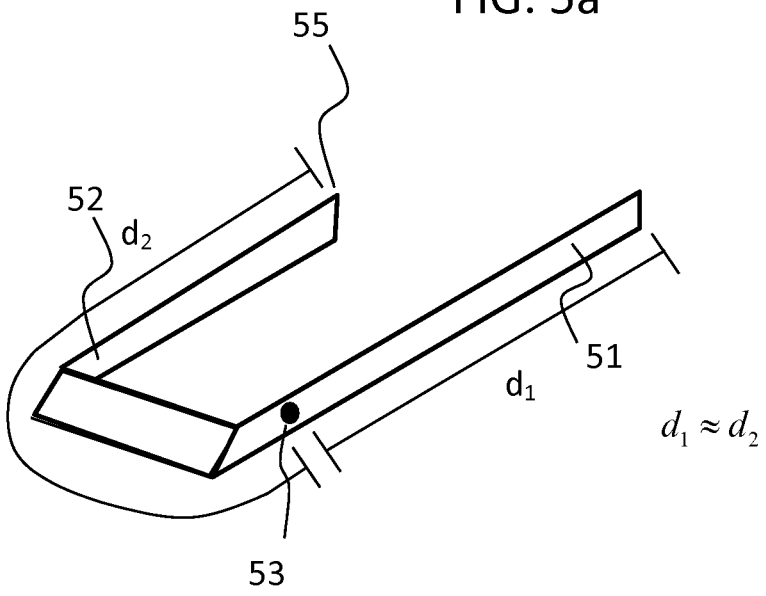

FIG. 5*b* shows schematically another embodiment of a hearing aid having an antenna according to the present disclosure. The antenna 55 comprises an excitation point 53, a first branch 51, and a second branch 52. The first branch 51 has a first length and the second branch 52 has a second length. The first length and the second length are seen to be similar or identical. The second length is the same length as the first length. In FIG. 5*b*, a first distance d1 from the excitation point to the first end is the same as a second distance d2 from the excitation point to the second end. The first or second length may be equal to the first distance d1 or the second distance d2, respectively. The distance is typically measured along the first branch 51 and the second branch 52, respectively.

The length of the first and/or second branches 51, 52 is at least λ/4 (where λ is the resonance wavelength for the wireless communications unit).

Figure 6:
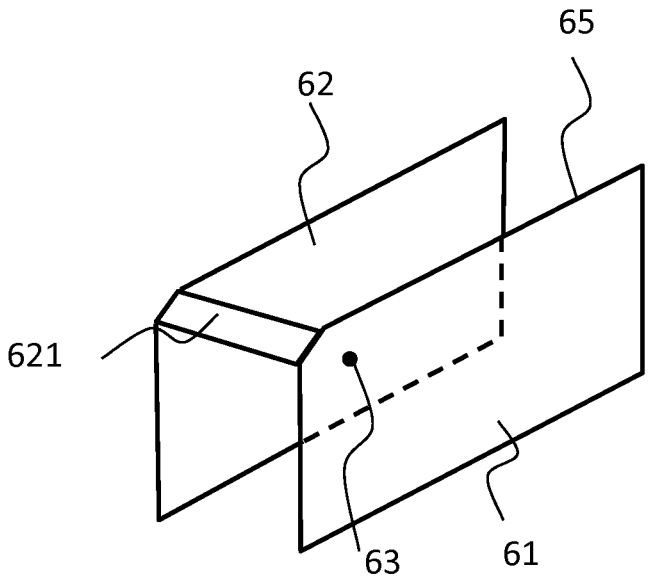
FIG. 6 shows schematically an exemplary implementation of an antenna according to an embodiment of the present disclosure.

FIG. 6 shows schematically an embodiment of a hearing aid having an antenna according to the present disclosure. The antenna 65 comprises an excitation point 63, a first branch 61, and a second branch 62. The first branch 61 is a plate. The second branch 62 comprises a plate and a bridge 621. The bridge 621 is a conducting element connecting the two plates, i.e. the first branch 61 and the second branch 62. In one or more embodiments, the length of the antenna branch may be measured along a top part of a plate forming the first and/or second branch 61, 62 is at least λ/8 and the length along a side part of a plate forming the first and/or second branch 61, 62 is at least λ/8, thus having a total first and/or second length along the current path of at least λ/4.

Figure 7:
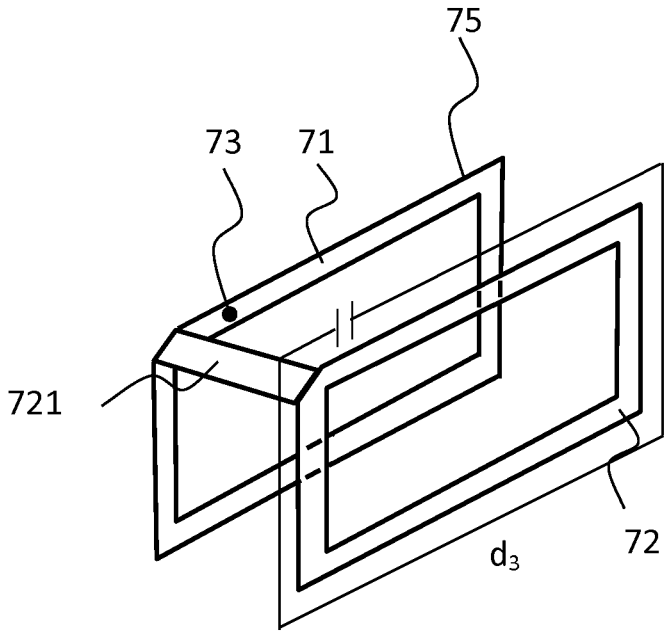
FIG. 7 shows schematically an exemplary implementation of an antenna according to an embodiment of the present disclosure.

FIG. 7 shows schematically an embodiment of a hearing aid having an antenna according to the present disclosure. The antenna 75 comprises an excitation point 73, a first branch 71, and a second branch 72. The first branch 71 forms a loop. The second branch 72 forms a loop and further comprises a bridge 721. The length d3 of the loop forming part of the second branch 72 may be small or it may be greater than λ/4. If the length d3 is greater than λ/4, the current has a zero at a point on the loop. The exact location of the zero depends on the magnitude of the current at the start of the loop (where the loop of the second branch 72 connects with the bridge 721) and the length d3 of the loop.

Figure 8:
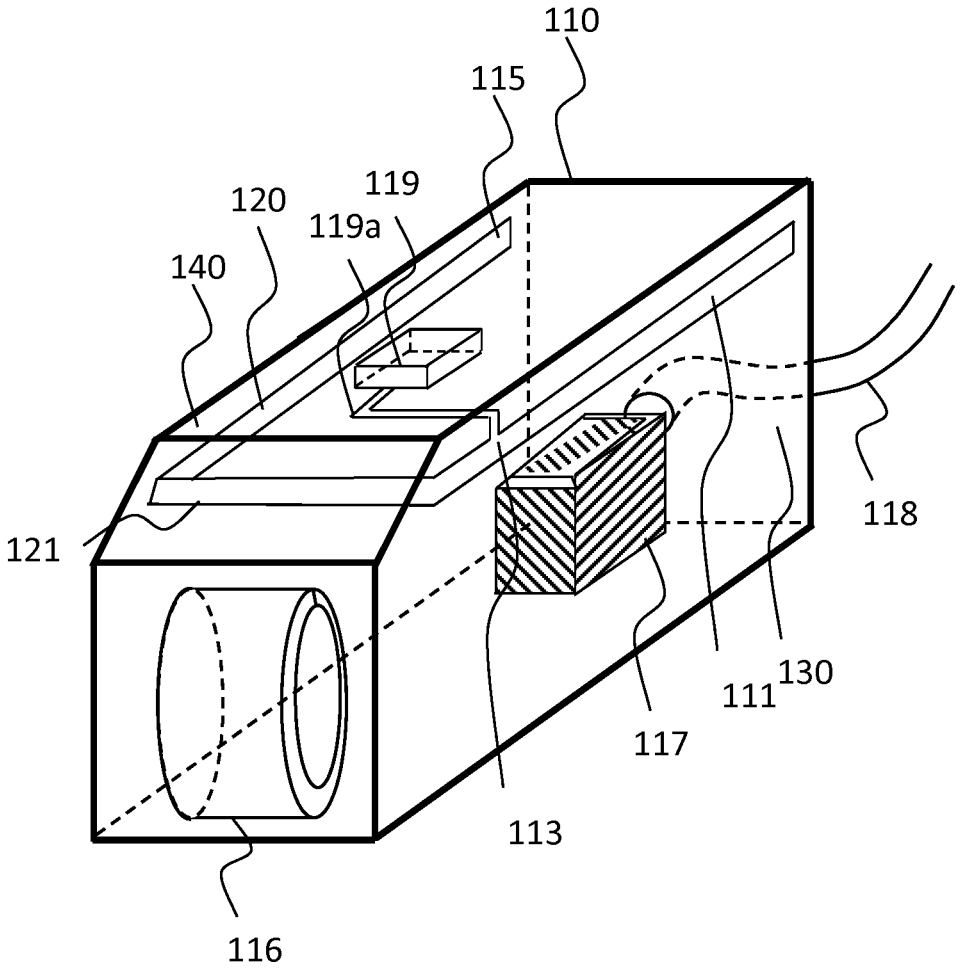
FIG. 8 is a 3D illustration of a behind-the-ear hearing aid having an exemplary antenna.

FIG. 8 is a 3D illustration of an exemplary behind-the-ear hearing aid having an antenna.

FIG. 8 shows a behind-the-ear hearing aid 110 configured to be positioned behind the ear of the user during use. The behind-the-ear hearing aid 110 comprises an antenna 115, a wireless communication unit 119 (e.g. a radio chip) with a transmission line 119*a* to an antenna 115, a battery 116, a signal processor 117 and a sound tube 118 leading to the entrance of the ear canal. The antenna 115 comprises an excitation point 113, a first branch 111, and a second branch 120. The second branch 120 comprises a part 121 extending from a first side 130 of the hearing aid assembly to a second side 140 of the hearing aid assembly. The first side 130 of the hearing aid assembly is opposite the second side 140 of the hearing aid assembly 110. The excitation point 113 is at the first side 130 of the hearing aid assembly. The first branch 111 may in one or more embodiments be a first structure, such as a first resonant structure, provided proximate the first side 130 of the hearing aid, and the second part 120 of the antenna 115 may in one or more embodiments a second structure, such as a second resonant structure, provided proximate a second side 140 of the hearing aid. At least a part of the first branch 111 extends on the first side 130. At least a part of the second branch 120 extends on the second side 140. The first side 130 or the second side 140 is positioned parallel with the surface of the head of the user when the hearing aid is worn in its operational position by the user. The first side 130 is a first longitudinal side of the hearing aid 110. The second side 140 is a second longitudinal side of the hearing aid 110.

Figure 9A:
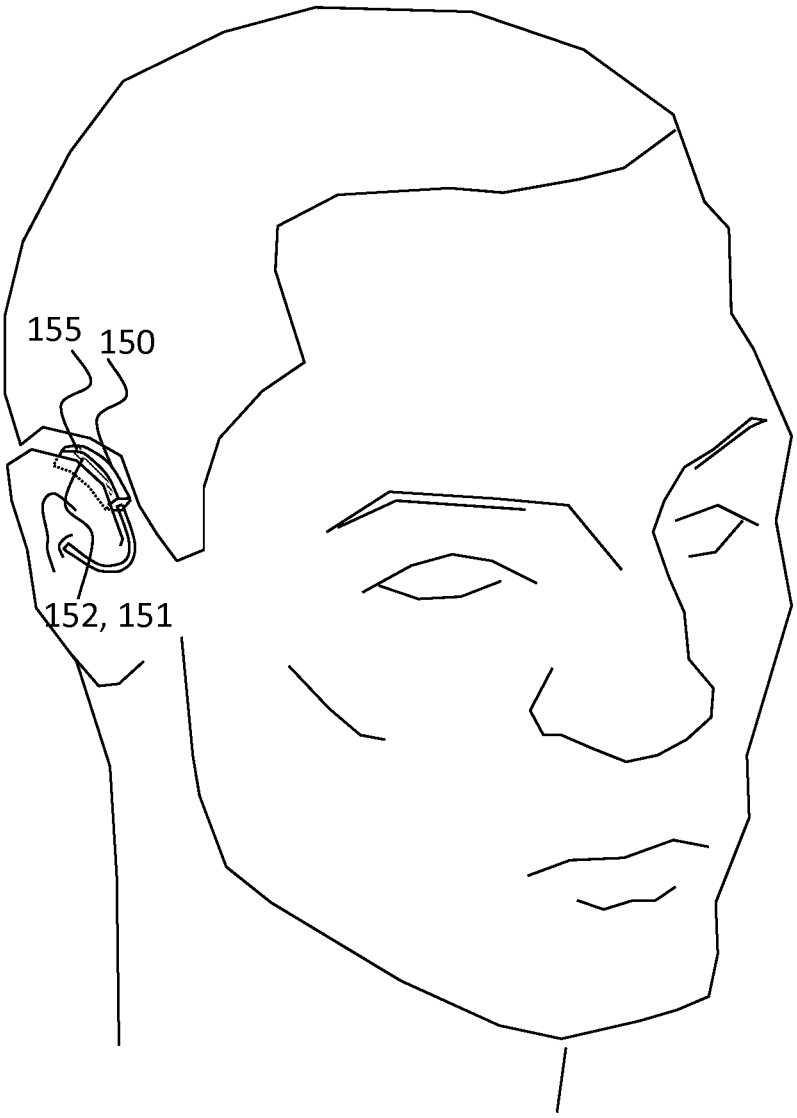
FIGS. 9*a-b* show a hearing aid positioned on the right and left ear of a user's head with the hearing aid comprising an antenna according to an embodiment of this disclosure.
Figure 9B:
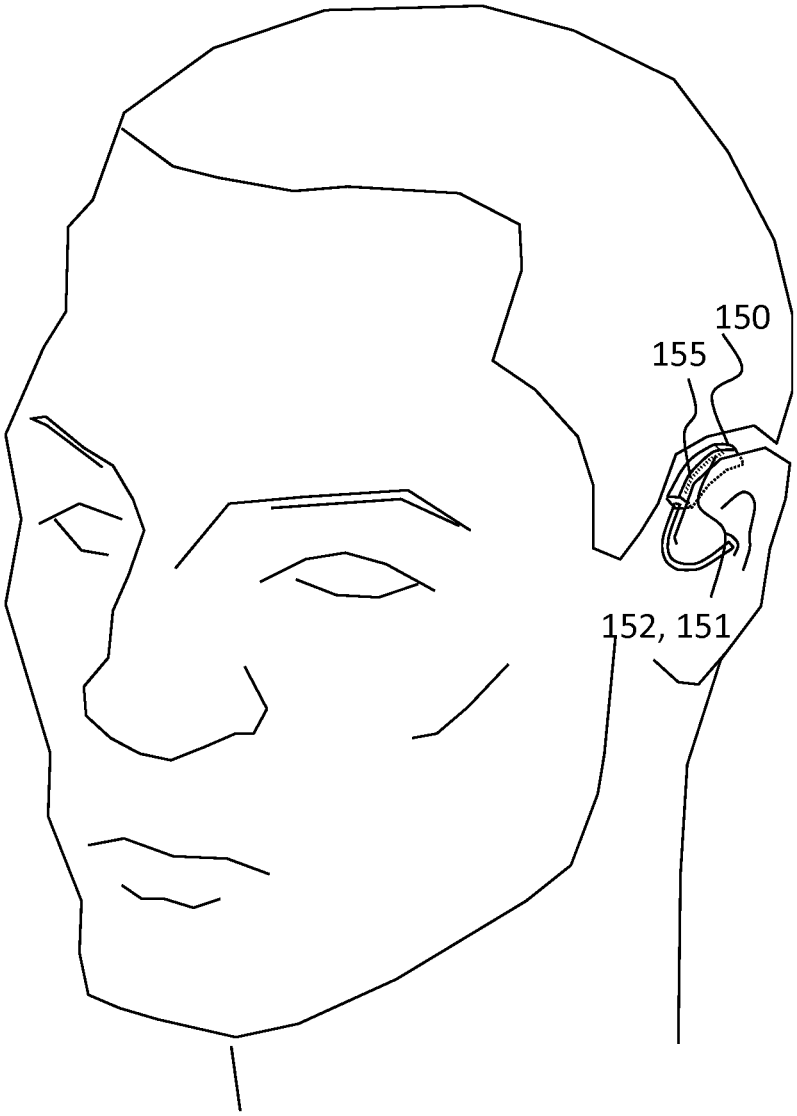

FIGS. 9*a-b* show an exemplary behind-the-ear hearing aid worn in its operational position by a user. FIG. 9*a* shows the behind-the-ear hearing aid 150 placed on the right ear of the user. The behind-the-ear hearing aid 150 comprises an antenna 155.

The antenna 155 comprises a first branch 151 and a second branch 152. The first branch 151 of the antenna is on the side of the hearing aid 150 facing away from the head of the user.

FIG. 9*b* shows the behind-the-ear hearing aid 150 placed on the left ear of the user.

In FIG. 9*b*, the second branch 152 (i.e. the other branch than the one shown in FIG. 9*a*) is on the side of the hearing aid 150 facing away from the head of the user.

FIGS. 9*a-b* illustrates the symmetry of the antenna implemented in a hearing aid according to this disclosure. The hearing aid disclosed herein is configured to be operational whether it is placed on the right ear or on the left ear.

The antenna 155 emits an electromagnetic field that propagates in a direction parallel to the surface of the head of the user when the hearing aid housing is positioned in its operational position during use, whereby the electric field of the emitted electromagnetic field has a direction that is orthogonal to, or substantially orthogonal to, the surface of the head during operation. In this way, propagation loss in the tissue of the head is reduced as compared to propagation loss of an electromagnetic field with an electric field component that is parallel to the surface of the head. Diffraction around the head makes the electromagnetic field emitted by the antenna propagate from one ear and around the head to the opposite ear.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid with an assembly, the assembly comprising:

a first side;

a second side;

a signal processor;

a wireless communications unit, the wireless communications unit being connected to the signal processor; and a monopole antenna for electromagnetic field emission and electromagnetic field reception, the antenna being connected to the wireless communications unit, the antenna having an excitation point;

wherein at least a part of a first branch of the antenna extends from the excitation point along the first side of the assembly, the first branch having a first end, the first end being free or being coupled with the excitation point via a third branch;

wherein a second branch of the antenna extends from the excitation point, at least a part of the second branch extending in a space located between the first side of the assembly and the second side of the assembly; and wherein the at least a part of the first branch is located closer to the first side of the assembly than the second side of the assembly of the hearing aid, and the second branch has a portion that is located closer to the second side of the assembly of the hearing aid.

2. A hearing aid with an assembly, the assembly comprising:

a first side;

a second side;

a signal processor;

a wireless communications unit, the wireless communications unit being connected to the signal processor; and a monopole antenna for electromagnetic field emission and electromagnetic field reception, the antenna being connected to the wireless communications unit, the antenna having an excitation point;

wherein at least a part of a first branch of the antenna extends from the excitation point along the first side of the assembly, the first branch having a first end, the first end being free or being coupled with the excitation point via a third branch;

wherein a second branch of the antenna extends from the excitation point, at least a part of the second branch extending in a space located between the first side of the assembly and the second side of the assembly; and wherein a current in the antenna has a maximum in the second branch.

3. A hearing aid with an assembly, the assembly comprising:

a first side;

a second side;

a signal processor;

a wireless communications unit, the wireless communications unit being connected to the signal processor; and a monopole antenna for electromagnetic field emission and electromagnetic field reception, the antenna being connected to the wireless communications unit, the antenna having an excitation point;

wherein at least a part of a first branch of the antenna extends from the excitation point along the first side of the assembly, the first branch having a first end, the first end being free or being coupled with the excitation point via a third branch;

wherein a second branch of the antenna extends from the excitation point, at least a part of the second branch extending in a space located between the first side of the assembly and the second side of the assembly; and wherein the excitation point is at an edge part of the assembly.

4. A hearing aid with an assembly, the assembly comprising:

a first side;

a second side;

a signal processor;

a wireless communications unit, the wireless communications unit being connected to the signal processor; and a monopole antenna for electromagnetic field emission and electromagnetic field reception, the antenna being connected to the wireless communications unit, the antenna having an excitation point;

wherein at least a part of a first branch of the antenna extends from the excitation point along the first side of the assembly, the first branch having a first end, the first end being free or being coupled with the excitation point via a third branch;

wherein a second branch of the antenna extends from the excitation point, at least a part of the second branch extending in a space located between the first side of the assembly and the second side of the assembly; and wherein the first branch has a first length and the second branch has a second length, and wherein a sum of the first length and the second length is at least 90% of a total length of the antenna.

5. The hearing aid according to claim 4, wherein the length of the first branch corresponds to the length of the second branch.

6. The hearing aid according to claim 1, wherein the at least a part of the second branch extends from proximate the first side of the assembly to proximate the second side of the assembly, or from the first side of the assembly to the second side of the assembly.

7. The hearing aid according to claim 1, wherein a length of the first branch is at least $\lambda/4$, and/or a length of the second branch is at least $\lambda/4$.

8. A hearing aid with an assembly, the assembly comprising:

a first side;

a second side;

a signal processor;

a wireless communications unit, the wireless communications unit being connected to the signal processor; and a monopole antenna for electromagnetic field emission and electromagnetic field reception, the antenna being connected to the wireless communications unit, the antenna having an excitation point;

wherein at least a part of a first branch of the antenna extends from the excitation point along the first side of the assembly, the first branch having a first end, the first end being free or being coupled with the excitation point via a third branch;

wherein a second branch of the antenna extends from the excitation point, at least a part of the second branch extending in a space located between the first side of the assembly and the second side of the assembly; and wherein a current in the antenna has a magnitude of zero at a point on the first branch and/or at a point on the second branch.

9. The hearing aid according to claim 1, wherein the second branch has a second end, and wherein the second end is free.

10. The hearing aid according to claim 1, wherein the second branch has a second end, and wherein the second end is coupled with the excitation point via a forth branch, the forth branch being different from the second branch.

11. The hearing aid according to claim 1, wherein a part of the second branch extends on the second side.

12. The hearing aid according to claim 1, wherein the first side is opposite the second side, and wherein the first side of the assembly corresponds with a first longitudinal side of the hearing aid, and the second side of the assembly corresponds with a second longitudinal side of the hearing aid.

13. The hearing aid according to claim 1, wherein a part of the second branch extends along the second side, and wherein the at least a part of the first branch extending along the first side and the part of the second branch extending along the second side are symmetric.

14. The hearing aid according to claim 1, wherein a length of the first branch is different from a length of the second branch.

15. The hearing aid according to claim 1, wherein another part of the second branch extends along the second side of the assembly.

16. The hearing aid according to claim 15, wherein the first side of the assembly is opposite from the second side of the assembly.

17. The hearing aid according to claim 1, wherein the at least a part of the first branch extends in a first direction that corresponds with an axis of the hearing aid; and wherein the second branch has a first portion extending in a second direction that corresponds with the axis of the hearing aid, and a second portion forming an angle relative to the axis of the hearing aid.

* * * * *